United States Patent [19]

Nakamura et al.

[11] Patent Number: 5,059,047

[45] Date of Patent: Oct. 22, 1991

[54] APPARATUS FOR CONTROLLING REVERSING DURATION OF HAMMER BANK IN SHUTTLE PRINTER

[75] Inventors: Takashi Nakamura; Masao Miyasaka; Toshio Hiki; Youichi Hujita; Kazunari Kodama, all of Katsuta, Japan

[73] Assignee: Hitachi Koki Co., Ltd., Tokyo, Japan

[21] Appl. No.: 478,854

[22] Filed: Feb. 12, 1990

[30] Foreign Application Priority Data

Feb. 10, 1989 [JP] Japan ..... 1-32243

[51] Int. Cl.[5] ..... B41J 19/30; B41J 3/00

[52] U.S. Cl. ..... 400/322; 101/93.04

[58] Field of Search ..... 101/93.04, 93.05, 93.09; 400/121, 124, 82, 322, 323

[56] References Cited

U.S. PATENT DOCUMENTS

| | | | |
|---|---|---|---|
| 3,941,051 | 3/1976 | Barrus et al. | 101/93.04 |
| 4,180,766 | 12/1979 | Matula | 101/93.04 |
| 4,473,313 | 9/1984 | Nakano et al. | 400/322 |
| 4,480,541 | 11/1984 | Grummett | 101/93.04 |
| 4,507,002 | 3/1985 | Matsumoto et al. | 400/322 |
| 4,637,307 | 1/1987 | Miller | 101/93.04 |
| 4,819,556 | 4/1989 | Abe et al. | 101/43.04 |
| 4,854,756 | 8/1989 | McCrimmon, Jr. et al. | 400/322 |
| 4,899,052 | 12/1989 | Matsumoto | 101/93.04 |

FOREIGN PATENT DOCUMENTS

| | | | |
|---|---|---|---|
| 0267125 | 5/1988 | European Pat. Off. | 101/93.04 |
| 0013560 | 1/1985 | Japan | 101/93.04 |
| 0015170 | 1/1985 | Japan | 101/93.04 |
| 0169258 | 7/1986 | Japan | 400/322 |
| 0153153 | 6/1988 | Japan | 400/323 |

*Primary Examiner*—Eugene H. Eickholt

*Attorney, Agent, or Firm*—Sughrue, Mion, Zinn, Macpeak & Seas

[57] ABSTRACT

A shuttle printer carries out printing on a printing paper when a hammer bank shuttles back and fourth. At the beginning of the hammer bank reversal at the right or left end in the hammer bank shuttling path, a braking force is exerted to a shuttle motor which drives the hammer bank and an acceleration force is exerted to the shuttle motor immediately after the hammer bank turns around. In order to set a reversing duration of the hammer bank at constant, the braking force and the acceleration force exerting durations are prolonged from a predetermined minimum to a value when the hammer bank reversing duration is shortened to an extent as desired, whereby a printing paper can be fed a predetermined amount within the hammer bank reversing duration as desired.

10 Claims, 4 Drawing Sheets

| PRINTING | REVERSING (PAPER FEEDING) | PRINTING |
|---|---|---|

APPARATUS FOR CONTROLLING REVERSING DURATION OF HAMMER BANK IN SHUTTLE PRINTER

BACKGROUND OF THE INVENTION

The present invention relates generally to a shuttle printer which carries out printing on a printing sheet while shuttling a hammer bank back and forth in a direction to traverse the printing paper, wherein the hammer bank carries a plurality of dot print hammers juxtaposed along a print line and is driven by a shuttle motor. More particularly, the invention relates to an apparatus for controlling a reversing duration of the hammer bank at constant, during which time the printing paper is fed a predetermined amount.

In such a shuttle printer, typically one or two dot lines are printed simultaneously during one scan of the hammer bank defined by the movement thereof from the left end to the right end or vice versa, and a printing paper is subsequently fed one or two dot lines in the reversing duration of the hammer bank defined by a period of time at which the hammer bank turns around at the left or right end. This one scan printing and the subsequent paper feeding are repeatedly carried out a predetermined number of times to thus print one print line, and thereafter the printing paper is fed four or six dot lines within the hammer bank reversing duration to thus provide the corresponding amount of interline space between the printed line and the following print line. In the shuttle printer in which printing is carried out on one or two dot line basis, the reversing duration of the hammer bank is sufficiently long in completing the paper feeding for providing the interline space.

There has been known a shuttle printer whose print hammer assembly has an arrangement such that six dot lines can be printed at a time. U.S. Pat. No. 4,889,052 discloses such a shuttle printer in which six dot lines are printed simultaneously during one scan of the hammer bank and the printing paper is fed twelve dot lines after completion of printing for one print line to provide corresponding amount of interline space. In this shuttle printer, the paper feeding for the interline space must also be completed within the reversing duration of the hammer bank. To this end, it is necessary that the reversing duration be precisely controlled because a larger amount of paper feeding must be performed within a limited period of time. If the hammer bank reversing duration is varied in the direction to be shortened, the interline space would be constricted or the paper settling time could not be preserved, with the result that the print quality is degraded. If the reversing duration of the hammer bank is set longer to obviate the above-mentioned drawbacks, a high speed printing cannot be achieved notwithstanding the fact that it is the initial contemplation to increase the printing speed by the provision of the print hammer assembly which can print six dot lines at a time with one scan of the hammer bank.

Nonetheless, it has been difficult to maintain the hammer bank reversing duration at constant. The reversing durations at which the hammer bank turns around at the right and left ends are different from each other due to the variation in precision of a shuttle mechanism. Further, the reversing duration changes depending upon the change of the load of the shuttle motor due to wear of the mechanism caused by aging.

Further, in a shuttle printer having dual printing mode, i.e., a high-speed and low-speed printing modes, there is a demand for changing the reversing duration depending upon the mode selected. In the high-speed printing mode, alpha/numerals are typically printed line by line at an interval of 30 dot lines in which 18 dot lines are allocated to the height of alpha/numerals and the rest of 12 dot lines to the interline space. Assuming that 6 dot lines are printed simultaneously during one scan of the hammer bank, printing for one print line is carried out in such a way that 6 dot lines are printed in the initial rightward scan of the hammer bank, the printing paper is fed 6 dot lines during a period of time when the hammer bank turns around at the left end, another six 6 dot lines are printed in the subsequent leftward scan, the printing paper is again fed 6 dot lines for a period of time when the hammer bank turns around at the right end, then still another 6 dot lines are printed in the rightward scan of the hammer bank, and thereafter the printing paper is fed 18 dot lines to have the interline space. In this manner, in the high-speed printing mode, the 18 dot line feeding is done within the reversing duration of the hammer bank. In the low-speed printing mode, on the other hand, the hammer bank reversing duration is set to a different value in conformity with the printing mode. In any event, it has been necessary to control the hammer bank reversing duration at constant depending upon the mode selected.

SUMMARY OF THE INVENTION

The present invention has been made to solve the above-described drawbacks accompanying the conventional shuttle printers, and accordingly it is an object of the present invention to provide a shuttle printer in which the reversing duration of a hammer bank can be controlled at constant.

In order to achieve the above and other object, there is provided in accordance with the present invention a shuttle printer comprising a hammer bank accommodating therein a plurality of dot hammers juxtaposed along a print line and carrying out printing on a printing sheet while shuttling back and forth along the print line, a shuttle motor rotatable at a predetermined rotational speed, a cam having a predetermined configuration and being driven by the shuttle motor, the cam imparting a shutting motion to the hammer bank, sheet feeding means for feeding a printing paper in a direction perpendicular to the print line, the printing paper being fed a predetermined amount during reversal of the hammer bank, the hammer bank reversing duration being preset to Tx which is determined by the configuration of the cam, the hammer reversing duration being changed to Ts for feeding the printing paper the predetermined amount within Ts, wherein Ts is longer (or shorter) than Tx, means for exerting a braking force to the shuttle motor at the beginning of the hammer bank reversing duration, and means for exerting an acceleration force to the shuttle motor immediately after the hammer bank turns around, the braking force and the acceleration force being exerted to the shuttle motor so that Tx is substantially equal to Ts.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
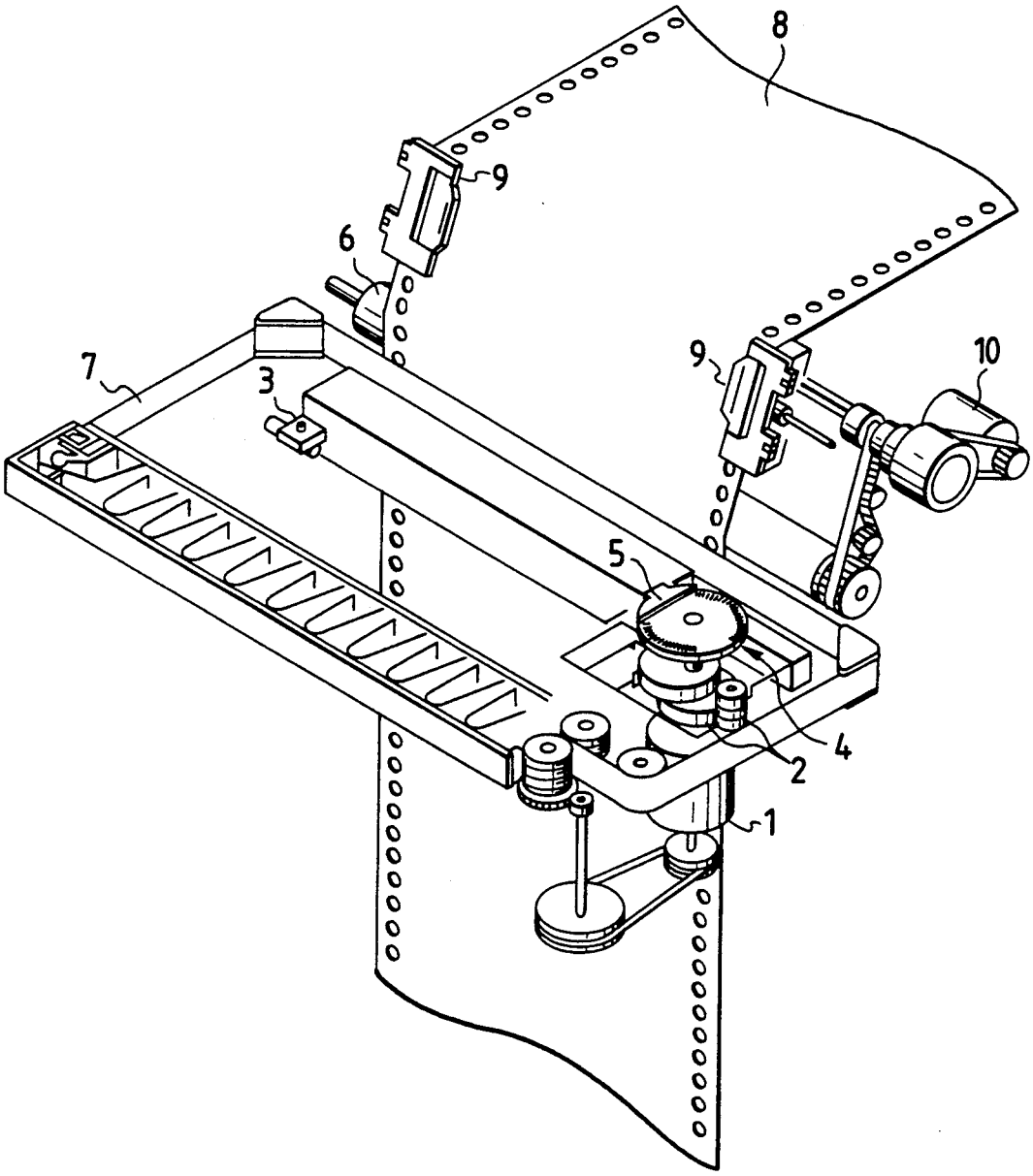
FIG. 1 is a perspective view showing one example of a shuttle printer.

The shuttle printer according to the present invention has an arrangement such as shown in FIG. 1. Although not shown in FIG. 1, a plurality of print hammers are accommodated in a hammer bank 3. Briefly, the print hammer is in the form of an elongated leaf spring having an upper end to which a dot pin is attached and a lower end secured to a mounting plate by means of, for example, screws. In the hammer bank, the print hammers are arranged to be equally spaced from one another and juxtaposed along a print line. A print hammer driver is provided in association with each print hammer, which includes a permanent magnet, a yoke and a release coil. The hammer is attracted to the face of the yoke pole by the permanent magnet and is released in response to the energization of the release coil, whereby the dot pin strikes the printing sheet 8 through an ink ribbon 7 to thus make an impression of a dot on the paper 8.

The hammer bank 3 is driven by a shuttle motor 1 through a cam 2 and is reciprocated along the print line with a single rotation of the motor 1. A rotary encoder 4 formed with a predetermined number of angularly spaced slits is mounted on a cam shaft. A photocoupler 5 consisting of a light emitting diode and a photodiode is disposed in association with the rotary encoder 4 for detecting an angular displacement of the rotary encoder 4.

A platen 6 is rotatably supported on a printer frame (not shown) for supporting the printing paper 8 thereon. A pair of pin tractors 9 are disposed in side marginal portions of the printing paper 8, which upon engaging perforations formed on the printing paper 8, train the printing paper 8 while cooperating with the platen 6. The printing paper 8 is fed in a direction perpendicular to the direction in which the hammer bank reciprocates. Both the platen 6 and the pin tractors 9 are driven by a paper feed motor 10.

The print hammers in accordance with the preferred embodiment of the present invention are divided into groups, each including six print hammers wherein the dot pin positions of the six hammers are displaced one dot line from one another in the sheet feeding direction, whereby six dot lines can be printed simultaneously with a single scan of the hammer bank.

Figure 2:
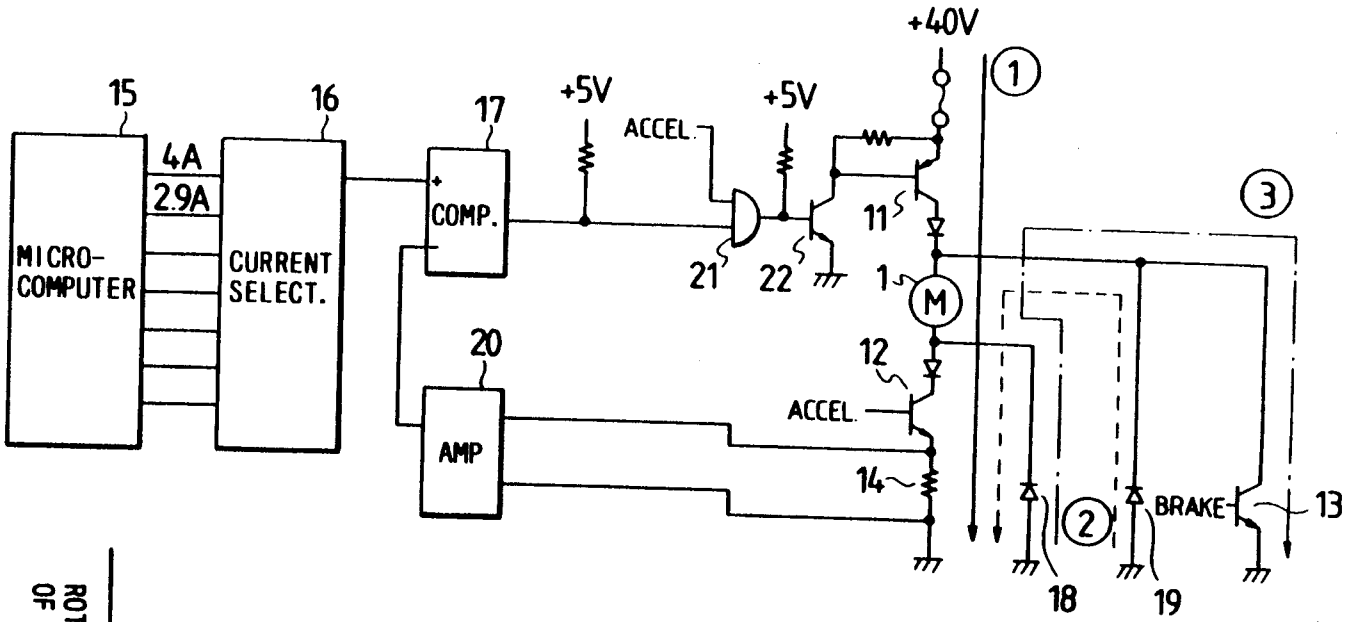
FIG. 2 is a circuit diagram showing one example of a shuttle motor driver according to the present invention.

FIG. 2 shows a driver circuit for the shuttle motor 1. The driver circuit includes two transistors 11, 12 and a current detecting resistor 14 which ar connected in series to the shuttle motor 1. Specifically, a PNP transistor 11 is connected between a positive power supply (+40V) and the shuttle motor 1, and a series connection of an NPN transistor 12 and the resistor 14 is connected between the shuttle motor 1 and ground. Positive terminal of the motor 1 is connected to ground separately through a diode 19 and a transistor 13. Negative terminal of the motor 1 is also connected to ground through a diode 18.

A microcomputer 15 is connected to a current selection circuit 16 which in turn is connected to a non-inverting terminal of a comparator 17. A current to be supplied to the shuttle motor 1, which may be 4 A or 2.9 A, is specified by the microcomputer 15 and is instructed to the current selection circuit 16. The latter circuit applies a reference voltage to the non-inverting terminal of the comparator 17, which reference voltage corresponding to the current specified by the microcomputer 15. On the other hand, a voltage developed across the resistor 14 is applied through an amplifier 20 to the inverting terminal of the comparator 17. The output of the comparator 17 is connected to one input of an AND gate 21, another input of which is supplied with an acceleration current. The output of the AND gate 21 is coupled to the transistor 11 through a complementary transistor 22.

In operation, the comparator 17 compares the voltage developed across the resistor 14 with the reference voltage supplied from the current selection circuit 16. When the voltage developed across the resistor 14 is lower than the reference voltage in an acceleration period of time during which the rotational speed of the shuttle motor 1 is to be accelerated, the transistor 11 is maintained at ON to thereby connect the positive power supply to the shuttle motor 1. Since the transistor 12 is also maintained at ON during the acceleration period, an acceleration current flows into the shuttle motor 1 from the transistor 11 and flows out through the transistor 12 and the resistor 14 along a path indicated by a solid line (1). On the other hand, when the voltage developed across the resistor 14 exceeds the reference voltage at the acceleration period, the transistor 11 is rendered OFF to thereby disconnect the positive power supply from the shuttle motor 1. At this time, the transistor 12 is still being ON. That fact that the resistor 14 is detecting a voltage greater than the reference voltage indicates that a current greater in level than that specified by the microcomputer 15 is being flowed in the shuttle motor 1. Therefore, the power supply to the shuttle motor 1 is interrupted and the acceleration current flows into the shuttle motor 1 from the diode 19 and flows out through the transistor 12 and the resistor 14 along a path indicated by a dotted line (2). As described, the transistor 11 serves as a current regulator for regulating the current supplied to the shuttle motor 1 so as to be in agreement with the level specified by the microcomputer 15.

In a braking period of which during which a braking force is to be exerted to the shuttle motor 1, both the transistors 11 and 12 are rendered OFF whereas the transistor 13 is rendered ON. Therefore, a braking current flows into the shuttle motor 1 from the diode 18 and flows out through the transistor 13 along a path indicated by a dotted chain line (3).

Figure 3:
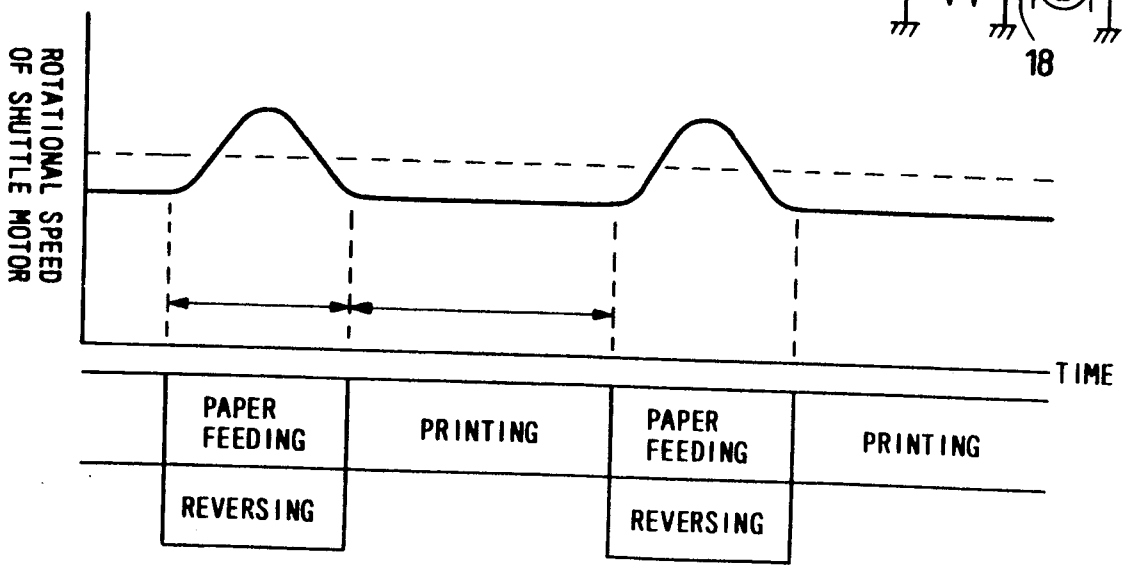
FIG. 3 is a waveform diagram showing the rotational speed of a shuttle motor.

FIG. 3 is a diagram showing a waveform of the rotational speed of the shuttle motor 1. At the first half of the hammer bank reversing duration, the shuttle motor 1 is imparted with a force of inertia of the hammer bank, which causes to increase the rotational speed of the shuttle motor 1 through the cam assembly 2. At the second half of the reversing duration, the rotational speed of the shuttle motor 1 is decreased and reached to a constant rotational speed at the time when the subsequent scan starts.

Figure 4:
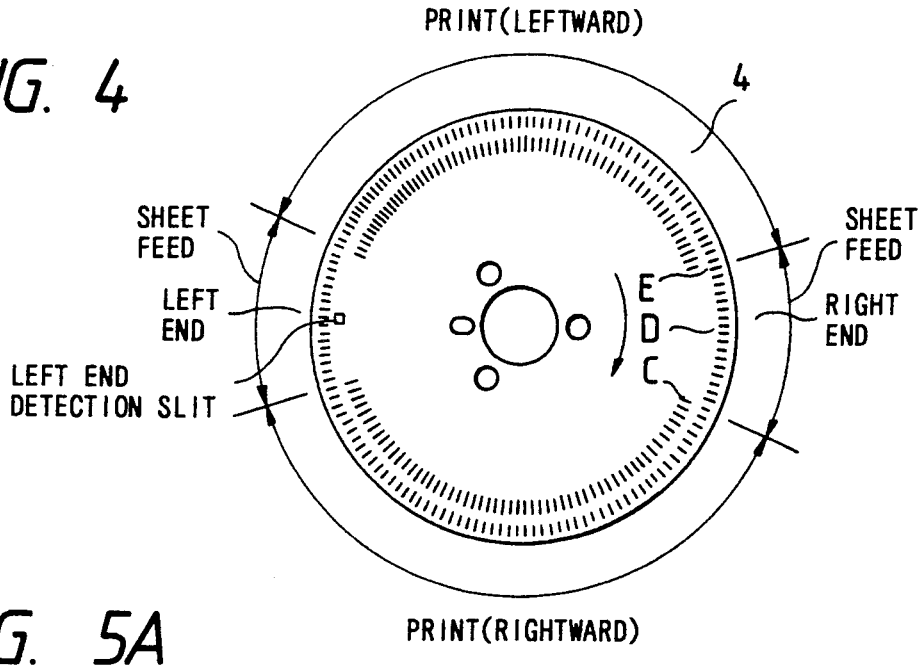
FIG. 4 is a plan view showing a rotary encoder mounted on the shuttle motor.

FIG. 4 shows the rotary encoder 4. Two hundreds and fifty six (256) slits are formed in the outer circumference of the disk, which slits are for controlling the rotational speed of the shuttle motor 1. Slits formed in the inner circumference of the disk are for producing hammer driving signals. A larger-width slit in the inner circumference is used to indicate that the hammer bank is positioned in the leftmost end.

Figure 5A:
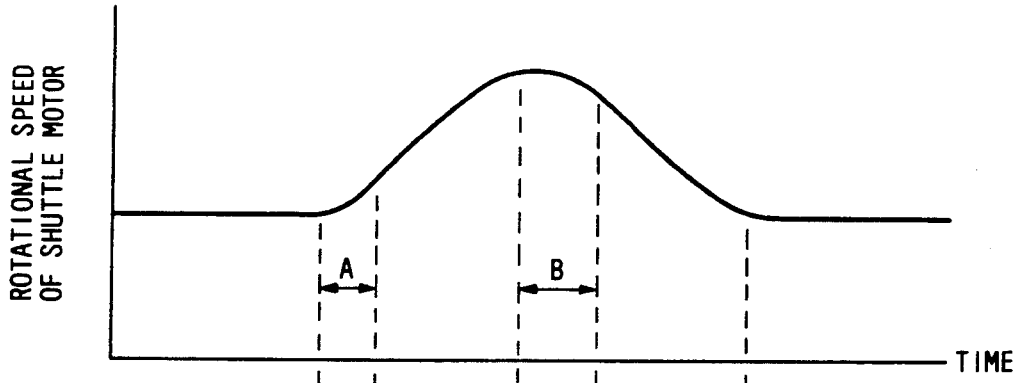
FIGS. 5A and 5B are waveform diagrams showing the rotational speed of the shuttle motor and a current flowed therein.
Figure 5B:
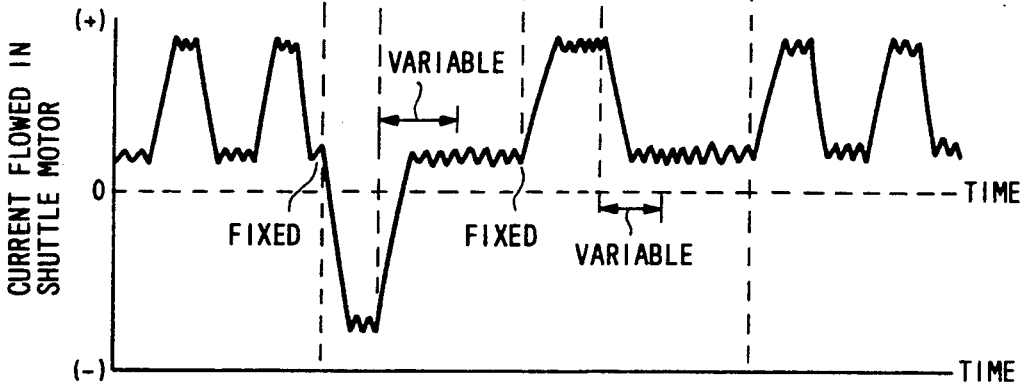

FIGS. 5A and 5B are waveform diagrams showing respectively the rotational speed of the shuttle motor 1 and the current flowing therein. In order to control the shuttle motor 1 so that the hammer bank reversing duration is at constant, a braking current is flowed in the shuttle motor 1 during a period of time A (hereinafter referred to as "braking interval A") at the beginning of the reversing duration, whereas an acceleration current is flowed therein during a period of time B (hereinafter referred to as "acceleration interval B") after the hammer bank is reversed or turned around. Flowing acceleration current in the motor 1 is necessary to increase the rotational speed of the shuttle motor 1 at the time when the subsequent scan starts.

Figure 6:
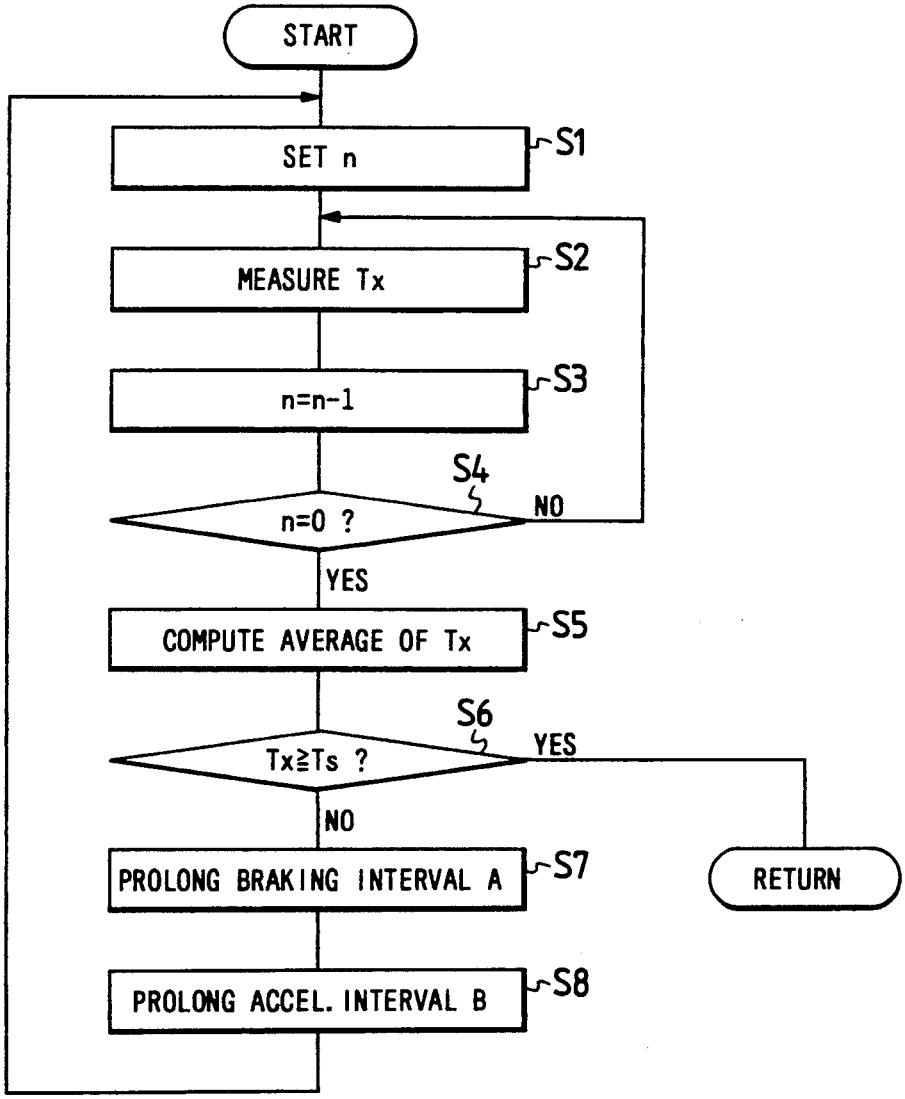
FIG. 6 is a flow chart illustrating sequence of operations to be performed for controlling the reversing duration of a hammer bank.

FIG. 6 is a flow chart illustrating sequence of operations to be performed for controlling the reversing duration of the hammer bank. It should be noted that the reversing durations at the left and right sides are controlled independently of each other. For the sake of simplicity, description will be given with respect only to the hammer bank reversing control performed at one side.

The braking and acceleration intervals A and B are initially set to minimum, whereupon measurement of the reversing duration Tx is commenced. The number of times that the measurement of the reversing duration Tx is performed is set in a counter (not shown) in step 1. Two to five times measurement would suffice. Therefore, an appropriate number selected from two to five is set in the counter. The first measurement of the reversing duration Tx is performed in step 2. The reversing duration Tx is measured by measuring a period of time during which the inner slits are not detected between the outer slits C and E corresponding respectively to the start and end points of the reversing duration. Upon completion of the first measurement, the counter value is counted down (step 3). The measurement is repeatedly carried out until the counter value becomes zero (step 4). Then, the reversing durations measured are averaged (step 5). The average of Tx is then compared with Ts representative of a target reversing duration (step 6). Since the cam 2 has been configured so that Ts is greater than Tx ($Tx<Ts$), the routine proceeds to step 7 where the braking and acceleration intervals A and B are prolonged (steps 7, 8). Specifically, the braking interval A is prolonged by extending the range of the measuring slits one by one originating from the slit C. Similarly, the acceleration interval B is also prolonged by extending the range of the measuring slits one by one originating from the slit D. Consequently, the periods of time during which the transistors 11, 12, 13 have been rendered ON are prolonged corresponding to on slit.

The routine returns to step 1 and the processings in steps 1 through 8 are repeatedly executed until the comparison in step 6 shows YES. When the comparison in step 6 indicates that Tx' representative of the updated value of Tx is equal to or greater than Ts ($Tx>Ts$), the control sequence terminates.

While the present invention has been described with reference to a specific embodiment of the present invention, a variety of changes and modifications may be made without departing from the scope and spirit of the invention. For example, the cam 2 may be configured so that Tx is greater than Ts ($Tx>Ts$), and the accelerating control of the hammer bank may be performed at the start of the reversing versing of the hammer bank takes place.

What is claimed is:

1. A shuttle printer comprising:

a hammer bank accommodating therein a plurality of dot hammers juxtaposed along a print line and carrying out printing on a printing sheet while shuttling back and forth along the print line;

a shuttle motor rotatable at a predetermined rotational speed;

a cam having a predetermined configuration and being driven by said shuttle motor, said cam imparting a shutting motion to said hammer bank;

sheet feeding means for feeding a printing paper in a direction perpendicular to the print line, the printing paper being fed a predetermined amount during reversal of said hammer bank, the hammer bank reversing duration being preset to Tx which is determined by the configuration of said cam, the hammer reversing duration being changed to Ts for feeding the printing paper the predetermined amount within Ts, wherein Ts is longer than Tx;

means for exerting a braking force to said shuttle motor at the beginning of the hammer bank reversing duration; and means for exerting an acceleration force to said shuttle motor immediately after said hammer bank turns around, the braking force and the acceleration force being exerted to said shuttle motor so that Tx is substantially equal to Ts.

2. A shuttle printer according to claim 1, wherein said braking force exerting means comprises means for prolonging a duration at which the braking force is exerted to said shuttle motor and wherein said acceleration exerting means comprises means for prolonging a duration at which the acceleration force is exerted to said shuttle motor.

3. A shuttle printer according to claim 2, further comprising measuring means for measuring the hammer bank reversing duration Tx' at which the braking and the acceleration force exerting durations are prolonged, comparison means for comparing the duration Tx' with the duration Ts and outputting a coincidence signal when the duration Tx' is equal to or shorter than the duration Ts, and setting means for setting the hammer bank reversing duration to Tx' in response to the coincidence signal.

4. A shuttle printer according to claim 3, wherein said measuring means measures the duration Tx' a plurality of times, and further comprising averaging means for computing an average of the durations Tx' measured by said measuring means.

5. A shuttle printer according to claim 4, wherein said measuring means measures the duration Tx equal plurality of times, and said averaging means computes an average of the durations Tx measured by said measuring means.

6. A shuttle printer comprising:

a hammer bank accommodating therein a plurality of dot hammers juxtaposed along a print line and carrying out printing on a printing sheet while shuttling back and forth along the print line;

a shuttle motor rotatable at a predetermined rotational speed;

a cam having a predetermined configuration and being driven by said shuttle motor, said cam imparting a shutting . motion to said hammer bank;

sheet feeding means for feeding a printing paper in a direction perpendicular to the print line, the printing paper being fed a predetermined amount during reversal of said hammer bank, the hammer bank reversing duration being preset to Tx which is determined by the configuration of said cam, the hammer reversing duration being changed to Ts for feeding the printing paper the predetermined amount within Ts, wherein Ts is shorter than Tx;

means for exerting an acceleration force to said shuttle motor immediately after said hammer bank turns around; and means for exerting a braking force to said shuttle motor at the beginning of the hammer bank reversing duration, the acceleration force and the braking force being exerted to said shuttle motor so that Tx is equal to Ts.

7. A shuttle printer according to claim 6, wherein said acceleration exerting means comprises means for prolonging a duration at which the acceleration force is exerted to said shuttle motor and wherein said braking force exerting means comprises means for prolonging a duration at which the braking force is exerted to said shuttle motor.

8. A shuttle printer according to claim 7, further comprising measuring means for measuring the hammer bank reversing duration Tx′ at which the braking and the acceleration force exerting durations are prolonged, comparison means for comparing the duration Tx′ with the duration Ts and outputting a coincidence signal when the duration Tx′ is equal to or shorter than the duration Ts, and setting means for setting the hammer bank reversing duration to Tx′ in response to the coincidence signal.

9. A shuttle printer according to claim 8, wherein said measuring means measures the duration Tx′ a plurality of times, and further comprising averaging means for computing an average of the durations Tx′ measured by said measuring means.

10. A shuttle printer according to claim 9, wherein said measuring means measures the duration Tx equal plurality of times, and said averaging means computes an average of the durations Tx measured by said measuring means.

* * * * *